175-40 SR
6/17/86 XR 4,595,343

United States Patent [19]

Thompson et al.

[11] Patent Number: 4,595,343

[45] Date of Patent: Jun. 17, 1986

[54] REMOTE MUD PUMP CONTROL APPARATUS

[75] Inventors: Steven R. Thompson, Moore; William D. Harbour, Jr., Norman, both of Okla.

[73] Assignee: Baker Drilling Equipment Company, Orange, Calif.

[21] Appl. No.: 649,705

[22] Filed: Sep. 12, 1984

[51] Int. Cl.[4] ..... F04B 21/00; E21B 47/00

[52] U.S. Cl. ..... 417/53; 417/63; 175/40; 175/217

[58] Field of Search ..... 417/2, 5, 7, 34, 53, 417/63, 426, 572; 175/24, 38, 40, 48, 217

[56] References Cited

U.S. PATENT DOCUMENTS

| | | | |
|---|---|---|---|
| 2,425,193 | 8/1947 | Lehr | 175/217 X |
| 2,632,631 | 3/1953 | Griffin et al. | 175/217 X |
| 3,362,487 | 1/1968 | Lindsey | 175/38 |
| 3,552,502 | 1/1971 | Wilson | 175/38 X |
| 3,817,658 | 6/1974 | Murase | 417/2 |
| 3,893,525 | 7/1975 | Dower et al. | 175/24 |
| 3,917,436 | 11/1975 | Dower | 417/34 X |
| 4,044,834 | 8/1977 | Perkins | 175/38 |
| 4,430,892 | 2/1984 | Owings | 175/48 X |

*Primary Examiner*—Carlton R. Croyle
*Assistant Examiner*—Paul F. Neils
*Attorney, Agent, or Firm*—Norvell & Associates

[57] ABSTRACT

Apparatus for controlling the operation of drilling or completion fluid pumps and a choke is disclosed. Control over the drilling or completion fluid pump can be independent of control of the choke. Control over the drilling fluid pump can be transferred to the choke control location. Pneumatic and electrical networks suitable for use with engine driven and electrically powered rigs are disclosed.

17 Claims, 6 Drawing Figures

REMOTE MUD PUMP CONTROL APPARATUS

BACKGROUND OF THE INVENTION

1. FIELD OF THE INVENTION

This invention relates to the circulation of fluid between the surface of a subterranean well and the bore hole and more specifically relates to the simultaneous control of drilling fluid circulation or mud pumps and a choke communicating with the pump.

2. DESCRIPTION OF THE PRIOR ART

Conventional apparatus used in rotary drilling operations includes a drilling fluid circulation pump or mud pump used to circulate drilling fluids from the surface through the well bore. These fluids are used to remove cuttings made by a rotary drill. In normal drilling fluid or mud circulation, the drilling fluid is pumped down through the drill pipe, discharged through the bit and returns to the surface in the annular space outside the drill pipe and inside the drill hole and casing placed in the well. The rate of drilling fluid circulation is determined by the necessary upward flow velocity required for removing cavings and drill cuttings from the hole and by the jetting requirements of the bit. The inherent advantage of the rotary system of drilling is that a fluid is circulated for the purpose of removing drill cuttings and maintaining a hole in such condition that the drill string can be withdrawn readily and returned to the bottom whenever necessary.

During conventional drilling it is not uncommon to encounter a sudden pressure increase or kick caused by the release of downhole liquids or gases under pressure which can affect drilling fluid circulation. When a kick is encountered, it can be necessary to vary the rate at which drilling fluid is injected into the well or to change the weight of the drilling fluid. A choke, in communication with the pump, is used to prevent significant pressure changes in conjunction with a change in the speed of operation of the mud pumps. For example, a significant increase in downhole pressure occurring as a result of an increase in the drilling fluid circulation can conceivably fracture the producing formation causing serious damage.

In normal drilling operations, the mud pumps are controlled by the driller, using a driller's console located at the driller's station on a rig to monitor relevant drilling parameters, including the speed of the mud pumps. Furthermore, conventional well control circulation operations also require manipulation of the choke to regulate or control the fluid pressure, especially during changes in the speed of the mud pump. On a conventional drilling rig, the choke is normally controlled from a choke console, which can be positioned on the drilling floor, at a position remote from the normal location of a driller's console on a surface rig. Simultaneous control of both the mud pumps and the choke requires communication between the driller and one manning the choke console. Such communication is difficult, especially on engine driven drilling rigs. The noise and the use of different types of gauges on a rig cause confusion and makes such communication difficult, especially on engine driven drilling rigs. Furthermore, a more accurate gauge for pump strokes rate is conventionally located at the choke console, but conventional apparatus provide no means for using this more accurate gauge at the choke console to control the pumps. In a crisis situation, where the drilling crew is attempting to control the well, increased emphasis is placed on efficient communication and operation, which is difficult using prior art devices.

SUMMARY OF THE INVENTION

Apparatus for controlling the circulation of well control or kill fluid in a subterranean well includes a pump and a choke communicating with the pump to deliver drilling fluids from the surface of the well into the bore hole and return to the fluid handling equipment. Apparatus for monitoring the condition of the pump is normally employed at the driller's console on the drilling rig and such pump monitoring apparatus includes a conventional pump control for regulating the speed and operation of the drilling fluid pumps. These pump controls can consist of pneumatic control valves or rheostats.

While control of the pump can be effected from the driller's console, control of the choke can be simultaneously effected using a choke control apparatus located at a choke console, normally located on the drilling floor at a location remote from the driller's console. A second pump control apparatus, again consisting of a conventional device, such as a pneumatic control valve or a rheostat, is located at the choke monitoring console and can be used to regulate pump speed and operation in the same manner as the first pump control apparatus located at the driller's console. Apparatus is provided for overriding the first pump control upon transmission of a signal from the second pump control. Such apparatus can comprise a pneumatic valve unit or an electrical relay consisting of normally closed and normally open switches which change state upon actuation of the second pump control apparatus. In the preferred embodiment of this invention, the overriding signal is the same as the pump control signal. When this pump control signal is transmitted, a valve or relay functions to override the first pump control apparatus. Signals transmitted from the second pump control located at the choke console can then be transmitted to the pumps.

In the preferred embodiment of this invention, the overriding apparatus comprises a portion of an interface network located in the driller's console, and the second pump control signal is transmitted from the choke console through the driller's console and subsequently to the drilling fluid or mud pumps. In this manner, control of both the pump and the choke can be transferred to the same location on the drilling rig to provide for better control over both the rate of circulation of the drilling fluids and over the pressure maintained in the bore hole. Such centralized control is quite useful in certain situations, such as when a kick is encountered.

DETAILED DESCRIPTION OF THE PREFERRED EMBODIMENTS

The preferred embodiments of the invention depicted herein are intended for use with conventional driller's consoles and choke consoles employed on diesel or electrically powered rigs commonly used for drilling subterranean wells. The interface network and remote pump control apparatus employed in the choke console are consistent with conventional commercially available components of driller's consoles and choke console.

Figure 1:
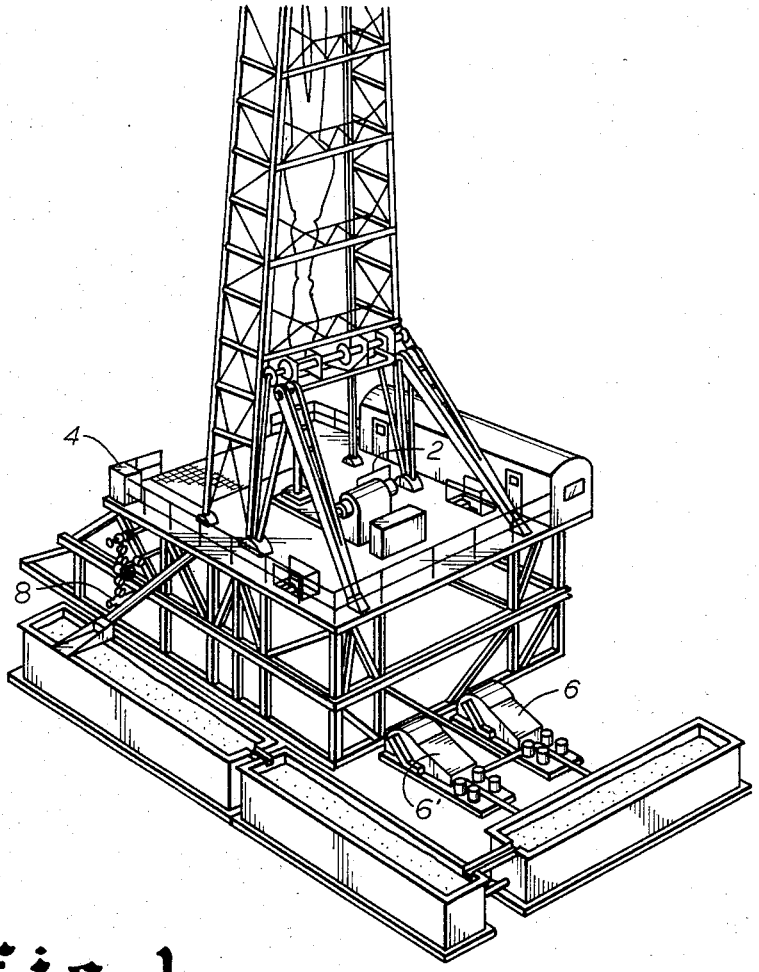
fig. 1 PRIOR ART
FIG. 1 is a generalized perspective view of the drilling rig showing the driller's console and the choke console.

FIG. 1 shows the conventional location of the driller's console 2 and choke console 4 between which signals are transmitted to regulate or control both mud pumps 6 and the choke 8. The choke console 4 located proximate to the choke 8 separately controls the operation of the choke. The driller's console 2 includes means for separately controlling the mud pumps 6 and signals may be transmitted from the choke console to the driller's console for regulating the operation and speed of the mud pump. It can be seen from FIG. 2 that in the preferred embodiment of this invention the choke console controls the pumps by signals transmitted through the driller's console 2. The transmission of signals between the various components shown in FIG. 2 can be by any of a number of conventional means, such as by electrical signals, by pneumatic or hydraulic signals, by fiber optic signals, by power line modulation, or in any other conventional form suitable for use on a drilling rig. A pneumatic control network for use with a diesel powered rig and an electrical interface network for use within an electrically powered drilling rig will be described herein.

Figure 3:
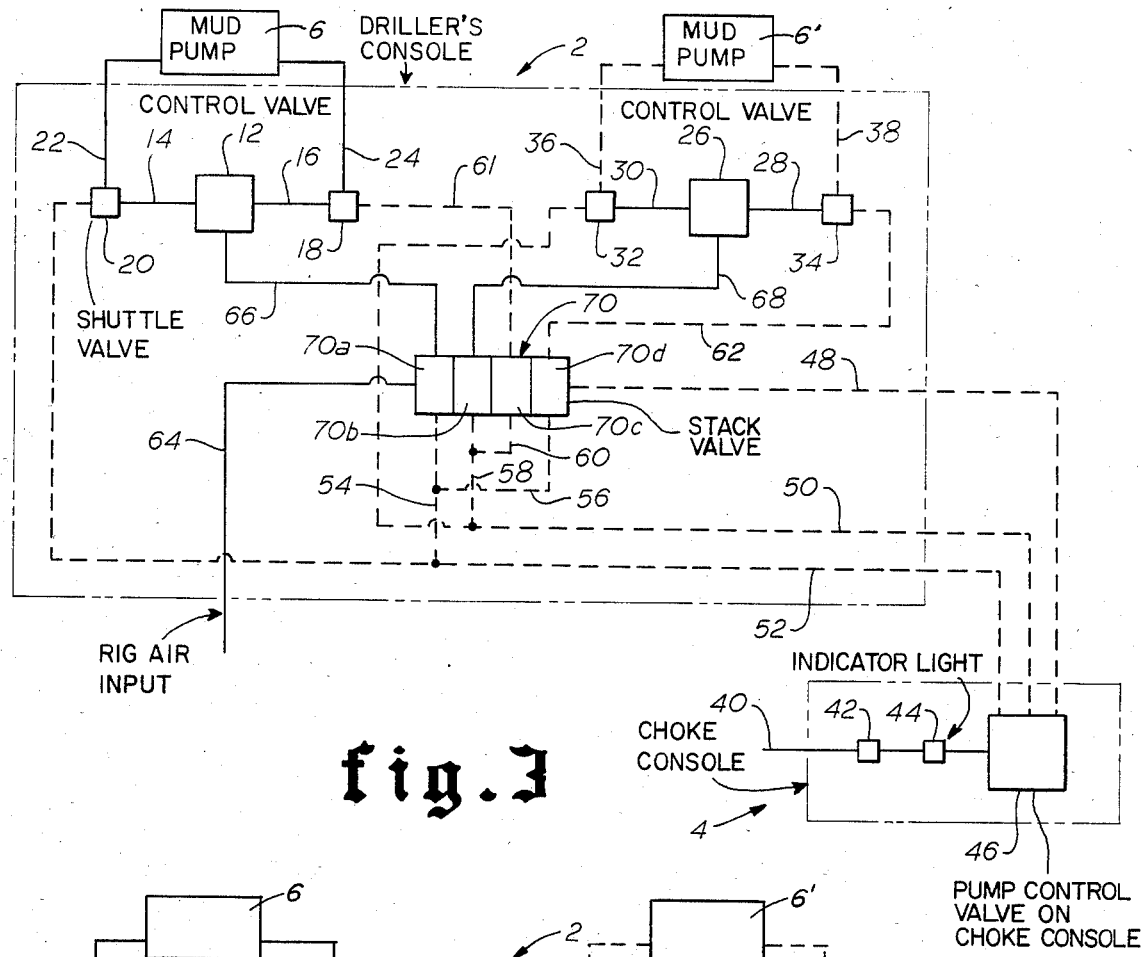
FIG. 3 is a schematic diagram of a pneumatic network showing the control of two mud pumps from the driller's console.
Figure 4:
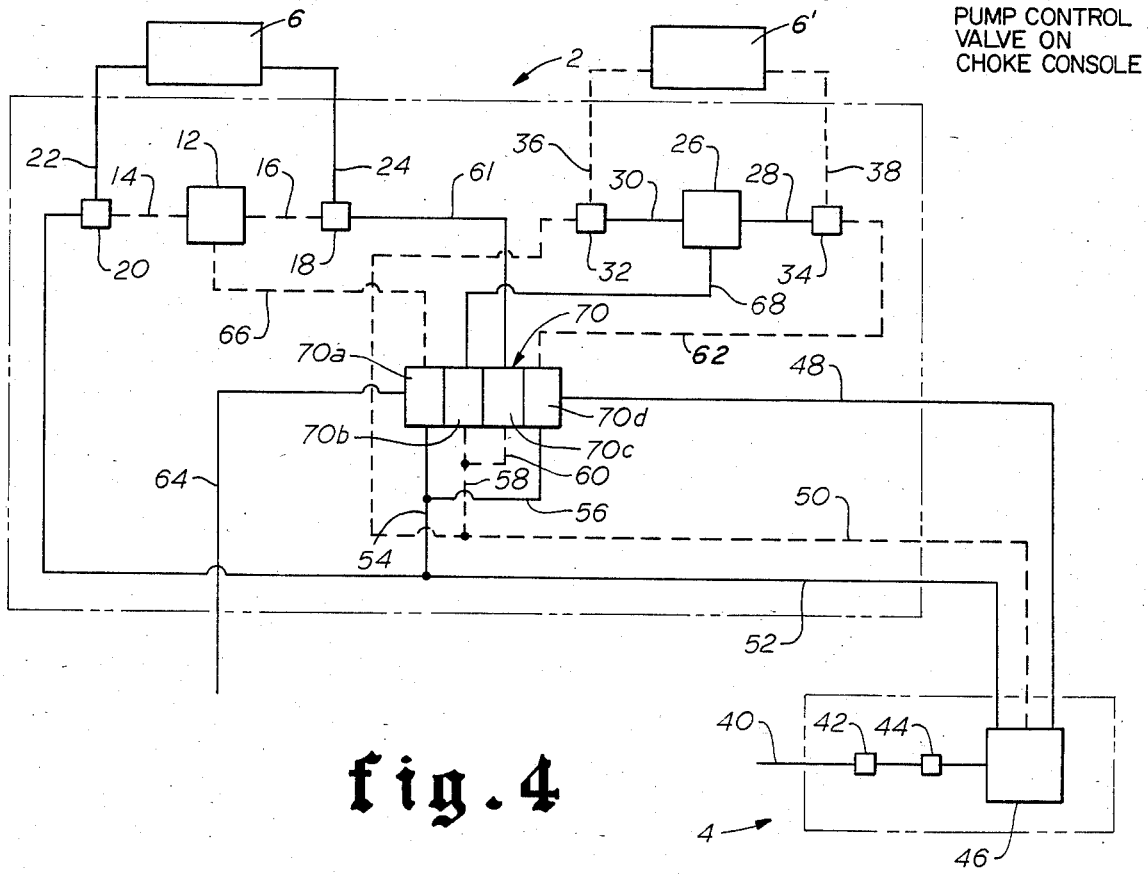
FIG. 4 is a schematic similar to FIG. 3 but showing the control of one mud pump from the choke console.
Figure 5:
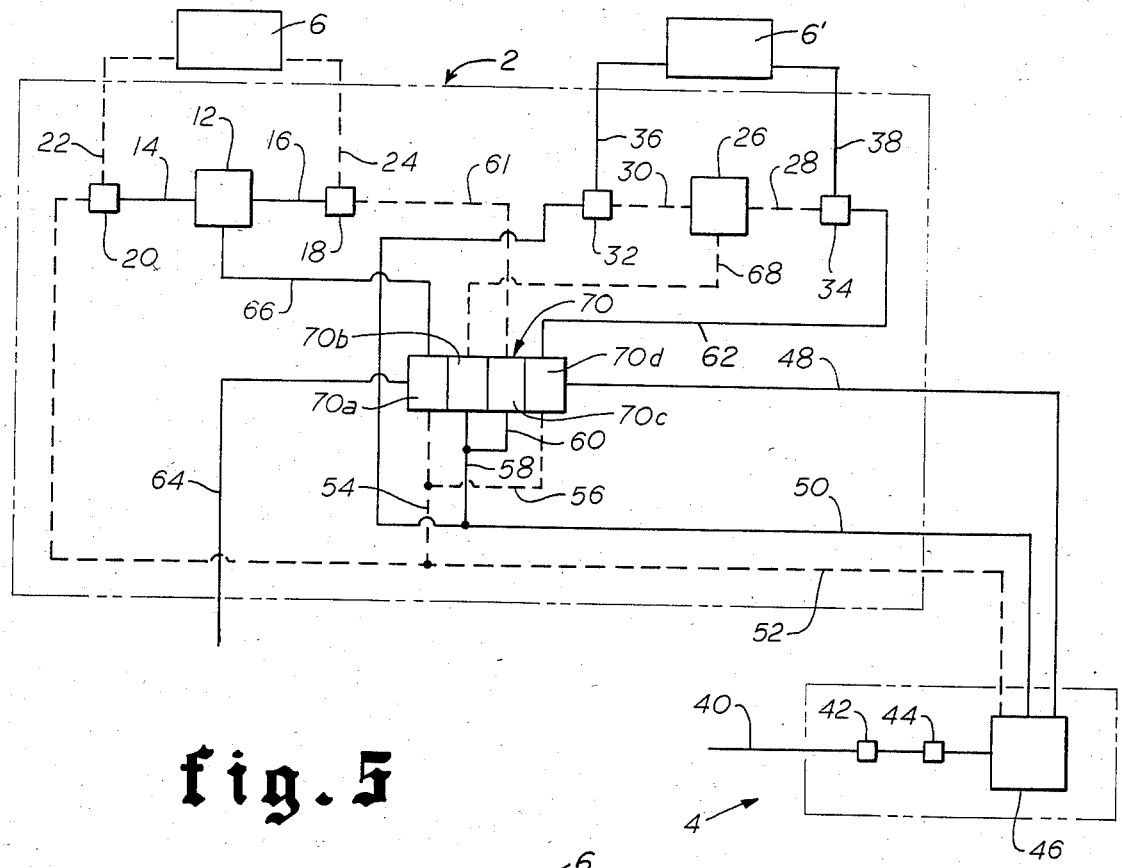
FIG. 5 is a view similar to FIG. 4 but showing the control of a different mud pump from the choke console.

FIGS. 3–5 depict the operation of a pneumatic interface network for a diesel powered rig. Only those portions of the pump control and the interface network relevant to the control of drilling fluid, circulating or mud pumps are depicted. Numerous other components are employed in a driller's console or in a choke console. Such components are, however, conventional and the components shown in FIG. 3 are compatible with other conventional components controlling the operation of a drilling rig. The pneumatic interface network for the diesel powered rig shown in FIG. 3 is intended for use in controlling two mud pumps. On conventional drilling rigs, two or more mud pumps are employed, although it is common practice to use only a single mud pump at a time, retaining the other mud pumps for redundancy and/or for emergency situations. The two pneumatic control valves 12 and 26 contained within the driller's console comprise conventional valves commonly employed in driller's console. Valves manufactured by American Standard having a pressure range of 0 to 100 psi for clutch and throttle signals represent one conventional valve for controlling the mud pump. A plurality of shuttle valves 18, 20, 32 and 34, each comprising a dual input-single output valve, are employed on opposite sides of each of the first or main pneumatic control valves 12 and 26 for controlling the operation of the mud pumps. Shuttle valves 18, 20, 32 and 34 may comprise conventional valves, such as the P-54350-2 shuttle valve manufactured by Wabco, an American Standard Company. Of course other similar valves could be used to form the isolation function of these shuttle valves. Valve 70, also located at the driller's console, comprises a four element stack valve unit consisting of valve elements 70*a*, 70*b*, 70*c* and 70*d*. Pneumatic valves 70 each comprise spring loaded, dual input, single output valves forming a valve stack 70. Individual valves are of conventional construction and comprise valves such as the A222PS valves manufactured by ARO Inc. which can be secured together by using an MKN stacking kit and an isolator plate manufactured by ARO Inc.

The pneumatic control valve 46 employed in the choke console comprises, in the preferred embodiment of this invention, an HD-2-FX pneumatic control valve having a pressure range from 0 to 100 psi, manufactured by American Standard. Pneumatic control valve 46 has a single input and three separate outputs. Valve 46 is located in the choke console and communicates with a conduit 40 providing air under pressure for use in actuating the various components depicted herein. A toggle switch 42 and an indicator light 44 are located on the choke console to insure that control is not transferred between the choke console and the driller's console at a time when the differences in the throttle settings between the choke console and the driller's console will create a serious pressure increase below the well, thus damaging the formation.

Three conduits 48, 50 and 52 extend from pneumatic control valve 46 to the driller's console. Conduits 50 and 52 comprise the clutch C1 and clutch C2 signal paths for controlling the chokes 8 and communicate between the pneumatic control valve 46 and the individual valve units of stack valve 70. Clutch C1 line 52 is interconnected to shuttle valve element 20 and clutch C2 transmission line 50 is interconnected to shuttle valve 32. A T-conduit 54 is interconnected to the clutch C1 line 52 intermediate its ends and the T-conduit 54 establishes fluid communication between the clutch C1 line 52 and the first valve unit 70*a*. A separate branch 56 establishes communication between T-conduit 54 and another unit 70*d* of the stack. Each of the stack valves 70*a*–70*d* comprises a normally spring loaded valve in which the input from either rig air conduit 64 or from throttle valve line 48 passes directly through valve units 70*a*–70*d*. The T-conduit 54 and its adjoining conduit 56 lead from clutch line 52 and communicate with an actuator port on valve units 70*a* and 70*d*. Fluid pressure in conduit 54 and 56 serves to shift the pneumatic valve units 70*a* and 70*d* to close lines 64 or 48 when pressure is applied to clutch C1 conduit 52.

The clutch C2 line 50 extends the pneumatic control valve 46 into the driller's console and communicates with shuttle valve 32. A T-conduit section 58 and branch 60 communicate with clutch C2 line 50 and with the remaining two valve units 70*b* and 70*c* at the actuator ports thereof. Pressure in clutch C2 line 50 will cause the valve units 70*b* and 70*c* to close against the action of a spring similarly disrupting the input from conduit 64 or 48 respectively.

The rig air input from conduit 64 into stack valve units 70*a* and 70*b* passes through lines 66 and 68 respectively to the pump control valves 12 and 26 when stack valves 70*a* and 70*b* are in the open position. Essentially, the stack valve units 70*a* and 70*b* are connected in parallel to the rig air source 64. The output conduits 61 and 62 leading from the stack valve units 70*c* and 70*d* are respectively connected to shuttle valves 18 and 34. Communication is normally established between throttle line 48 and valves 18 and 34 through the stack valve units 70*c* and 70*d* when the spring loaded valves are in their normally open position.

The first pneumatic control valves 12 and 26 comprise conventional elements for generating clutch and throttle signals in response to a constant pressure supply or rig air in conduit 64. For example, valve 12 generates a clutch signal in line 14 and a throttle signal in line 16. Clutch line 14 communicates with one of the two input ports of shuttle valve 20. Throttle line 16 communicates with one of the two input ports of shuttle valve 18.

FIG. 3 depicts a condition in which the mud pumps 6 and 6' can be controlled by using the first or primary mud pump controllers 12 and 26. It should be understood that in an actual practice, only one pump is normally used. Solid lines have been used to indicate that pneumatic signals communicate through the line, while dashed lines indicate that the line has been disabled and no signal is transmitted. As shown by the solid lines in FIG. 3, pressure in line 64, which is obtained from a source of rig air, communicates through the normally open stack valves 70*a* and 70*b* to lines 66 and 68 respectively. Rig air is then applied to pneumatic control valves 12 and 26. Referring to control valve 12, the presence of rig air at the input of this first control valve permits clutch and throttle signals to be generated in lines 14 and 16 respectively. Since the choke console pneumatic control valve is in the off position, as shown in FIG. 3, and there is no pressure in lines 48, 50 and 52, a pneumatic signal is applied in only one of the dual input ports of shuttle valves 18 and 20. A pneumatic clutch signal in line 14 can be transmitted through shuttle valve 20 and clutch line 22 directly to the drilling fluid or mud pump. Similarly, a throttle signal in line 16 would be transmitted through shuttle valve 18 and line 24 to the pump. Thus the pneumatic throttle and clutch signals to pump 6 are employed to control the operating speed of an internal combustion engine, for example, driving pump 6 and an operating clutch to engage or disengage the pump as desired or required.

FIG. 4 shows the condition in which the choke console pneumatic control valve 46 is actuated to apply a pneumatic signal in clutch line 52 and in throttle line 48. Pneumatic control valve 46 is of the type that actuation of a control lever in one direction will induce a clutch signal during initial movement and thereafter will produce a throttle signal. The pneumatic signal in clutch line 52 acts through lines 54 and 56 on the actuator ports of stack valve units 70*a* and 70*d*. Pressure applied at the actuator ports plugs the input lines to stack valve units 70*a* and 70*d*. Thus the rig air from line 64 is plugged by stack valve unit 70*a* thus disabling the first mud pump control valve 12 which comprises the primary means of regulating the mud pump 6 from the driller's console. The pneumatic signal in line 52 is, however, transmitted to the second input port of shuttle valve 20. Since there is no pressure in line 14, any clutch signal in line 52 at shuttle valve 20 will be transmitted through line 22. The pneumatic signal in line 52 communicating with line 56 also disables the throttle input to stack valve unit 70*d* isolating shuttle valve 34 from the throttle line 48. Stack valve unit 70*c*, however, remains open and the pneumatic signal in throttle line 48 will be transmitted through line 61 to shuttle valve 18. This pneumatic signal in line 61 is in turn transmitted through throttle line 24 to the first mud pump. Similarly, the stack valve unit 70*b* remains open and rig air from conduit 64 flows through line 68 to the secondary driller mud pump control valve 26.

FIG. 5 shows the same pneumatic control circuit in which the choke console pump control valve 46 has been actuated to generate a pneumatic clutch C2 signal in line 50. This pneumatic signal in line 50 communicates through lines 58 and 60 to the actuating ports of stack valve units 70*b* and 70*c* to close the input ports from the rig air conduit 64 and from the throttle line 48 respectively. Valve units 70*a* and 70*d*, however, remain open. Rig air can thus be applied to pump control valve 12 and the pneumatic signal in throttle line 48 can be transmitted through stack valve unit 70*d* to one input port of shuttle valve 34. Similarly, the pneumatic signal in clutch C2 line 50 is transmitted to an input port of shuttle valve 32. A clutch signal derived from the pneumatic control valve 46 can thus be applied through line 36 to the second mud pump. Similarly, a throttle signal 38 determined by the position of pneumatic control valve 46 can be applied through shuttle valve 34 and line 38 to the second mud pump. Choke console pneumatic control valve 46 is of the type that actuation of an input lever in a first direction will apply a signal in clutch C1 line 52 and in throttle line 48, while actuation of the control valve unit in the opposite direction will result in the presence of a pneumatic signal in clutch C2 line 50 and in the throttle line 48. It will be understood that separate choke control elements are contained within the choke console for positioning the choke in the proper position. When the apparatus is in the configurations of FIGS. 4 and 5, the choke control valve 46 can also be used to control either mud pump 6 or mud pump 6'.

Figure 2:
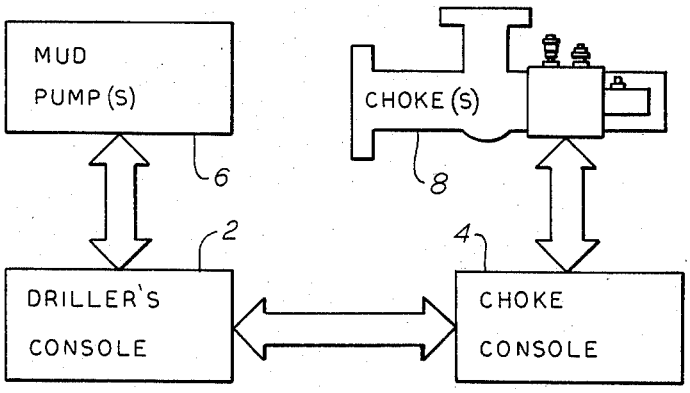
FIG. 2 is a schematic showing control of the choke and mud pumps from the driller's console and/or the choke console.
Figure 6:
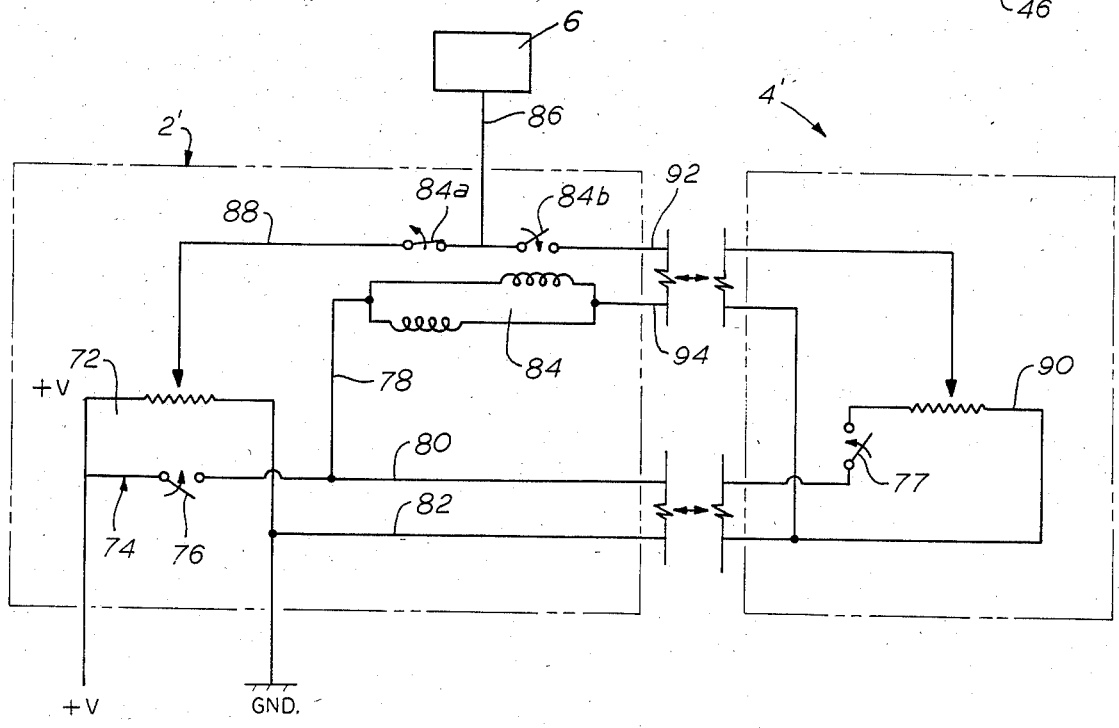
FIG. 6 is a schematic of an electrical network for controlling a pump.

FIG. 6 shows an electrical interface network for use with an electrically powered rig. Again, separate drillers and choke consoles can be used in the same manner as shown in FIG. 2. In this electrically powered network, rheostat 72 provides a control signal through path 88 and normally closed relay 84*a* and line 86 to an SCR housing for controlling the operation and speed of a single mud pump. A second rheostat 90 located on the choke console is normally isolated from SCR housing line 86 by a normally open relay 84*b*. The configuration of FIG. 6 shows the conventional operation of the mud pump 6 by means of the pump controlling rheostat 72 located in the driller's console. When it is desired to control the mud pump by use of the choke mud pump control rheostat 90, switches 76 and 77 are closed. When switch 76 is closed, the relay 84 changes state and the normally open relay 84*b* is closed permitting regulation of the mud pump by the choke console mud pump rheostat 90. Closure of switch 76 results in the application of a voltage to the relay 84 thus changing the state of relays 84*a* and 84*b* to override the signal from the driller's console mud pump rheostat 72 when it is desired to control the mud pump from the remote position of the choke console. Note that the common +V line 80 and ground line 82 lead between the driller's console and the choke console. If for any reason these lines are severed, control of the mud pump automatically reverts to the driller's console rheostat 72. Thus, the mud pump 6 or mud pump 6' can be controlled from the driller's console or through the remote position of the choke console depending upon closure of electrical switch 76.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for controlling the circulation of fluid in a subterranean well comprising:

a pump;

a choke communicable with the pump;

pump monitoring means for regulating the pump speed to vary the flow rate of the circulating fluid;

choke monitoring means located at the surface of the well remote from the pump monitoring means and including choke regulating means for varying the fluid flow area through the choke to control the pressure of the circulating fluid as the flow rate is changed by variations in the pump speed; the improvement comprising:

a second pump control means incorporated in the choke monitoring means and communicable with the pump through the pump monitoring means for regulating the pump speed.

2. Apparatus for use on a surface drilling rig for controlling a drilling fluid circulation pump and a choke communicable with the pump during the circulation of drilling fluids between the surface and the borehole of a subterranean well, the apparatus comprising:

a first pump control means for regulating the operation and speed of the pump to vary the flow rate of the circulating fluid;

second pump control means communicable with the pump and said first pump control means for varying the operation and speed of the pump, located proximate to the choke and remote from the first control means and from the pump; and overriding means proximate to the first pump control means responsive to a signal for disabling the first pump control means upon actuation of the second pump control means, the second pump control means communicating with the pump through the overriding means.

3. The apparatus of claim 2 wherein the overriding means is connected to the first and second pump control means and comprises means for automatically transferring control over the pump to the first pump control means when no signal is received from the second pump control means.

4. The apparatus of claim 3 wherein the first and second pump control means and the overriding means comprise fluid means.

5. The apparatus of claim 4 wherein the first and second pump control means comprises means for generating separate throttle and clutch signals for controlling the speed and operation of the pump.

6. The apparatus of claim 5 wherein the overriding means comprises a valve interposed between the first pump control means and a source of fluid pressure, the valve being shiftable to isolate the first pump control means from the source of fluid pressure in response to a fluid pressure signal from the second pump control means.

7. The apparatus of claim 6 further comprising double input, single output valves interconnected at the inputs to the first and second pump control means, the output communicating with the pump.

8. Apparatus for controlling the circulation of fluid in a subterranean well comprising:

a pump;

a choke communicable with the pump;

pump monitoring means located at the surface of the well and including first pump control means for regulating the pump speed to vary the flow rate of the circulating fluid;

choke monitoring means located at the surface of the well remote from the pump monitoring means and including choke regulating means for varying the fluid flow area through the choke to control the pressure of the circulating fluid as the flow rate is changed by variations in the pump speed; the improvement comprising:

a second pump control means incorporated in the choke monitoring means and communicable with the pump through the pump monitoring means for regulating the pump speed; and means for disabling the first pump control means upon actuation of the second pump control means, whereby the pump and the choke can be controlled from the same location at the surface of the well to regulate the flow rate and pressure of the circulating fluid.

9. The apparatus of claim 8 further comprising interconnecting means between the pump monitoring means and the choke monitoring means.

10. The apparatus of claim 8 wherein the first and second pump control means and the disabling means comprise electrical means.

11. The apparatus of claim 10 wherein the first and second pump control means comprise rheostats and the disabling means comprises normally open and normally closed relays.

12. The apparatus of claim 2 wherein the means for disabling the first pump control means is incorporated in the pump monitoring means.

13. The apparatus of claim 12 further comprising means for transmitting a clutch signal and a throttle signal from the pump monitoring means to the pump.

14. The apparatus of claim 13 wherein the first and second pump control means and the disabling means comprise fluid means.

15. Apparatus for varying the fluid flow of drilling fluid circulating between a surface drilling rig and subsurface locations in a subterranean well borehole in response to kicks occuring during drilling, comprising:

drilling means including a drilling fluid pump located on the surface drilling rig;

a choke spaced from the pump to the surface drilling rig and communicable with the pump;

drilling monitoring means located on the surface rig for monitoring the drilling means including pump monitoring means, further including first pump control means for regulating the operation and speed of the pump to vary the flow rate of the circulating fluid in response to a kick;

choke monitoring means proximate the choke and remote from the drilling monitoring means and including choke regulating means for varying the fluid flow area through the choke to control the pressure of circulating fluid as the flow rate is varied by the operation and speed of the pump; the improvement comprising;

a second pump control means incorporated in the choke monitoring means and communicable with the pump through the pump monitoring means for regulating the operation and speed of the pump; and means for disabling the first pump control means upon actuation of the second pump control means, whereby the pump and choke can be controlled at the choke to regulate the flow rate and pressure of the circulating fluid in response to kicks occurring during drilling.

16. A method for use in controlling the circulation of drilling fluid between the surface and the borehole of a subterranean well from a choke monitoring console proximate to a choke and remote from a pump and from a drilling monitoring console on a drilling rig, comprising the steps of:

controlling the pump from the drilling monitoring console and the choke from the choke monitoring console in the absence of an overriding signal from the choke monitoring console to the drilling monitoring console;

overriding control of the pump by the drilling monitoring console by transmitting an overriding signal to the drilling monitoring console from the choke monitoring console; and thereafter, controlling both the pump and the choke from the choke monitoring console.

17. The method of claim 16 wherein the signals controlling the pump transmitted from the choke monitoring console comprise the overriding signal.

* * * * *